United States Patent [19]

Skubich et al.

[11] 4,243,106

[45] Jan. 6, 1981

[54] DEVICE FOR SETTING BLADE OF EARTHMOVER

[75] Inventors: Otto Skubich, Hanover; Rudolf Perkert, Seelze; Karl Heinz Fischer, Laatzen, all of Fed. Rep. of Germany

[73] Assignee: Massey-Ferguson Services N.V., Curacao, Netherlands Antilles

[21] Appl. No.: 2,909

[22] Filed: Jan. 12, 1979

[30] Foreign Application Priority Data

Jan. 13, 1978 [DE] Fed. Rep. of Germany ..... 2801296

[51] Int. Cl.[3] ..... E02F 3/76

[52] U.S. Cl. ..... 172/804; 91/401; 91/511; 91/520

[58] Field of Search ..... 172/801-809; 91/401, 413

[56] References Cited

U.S. PATENT DOCUMENTS

| | | | |
|---|---|---|---|
| 3,004,524 | 10/1961 | McCay | 91/401 X |
| 3,184,869 | 5/1965 | Olsen | 172/803 |
| 3,311,026 | 3/1967 | Crisp | 91/401 |
| 3,315,570 | 4/1957 | Brewer | 91/401 |
| 3,515,224 | 6/1970 | Seaberg | 91/401 X |
| 3,581,829 | 6/1971 | Frisbee | 172/804 |
| 3,631,930 | 1/1972 | Peterson | 172/804 |
| 3,705,631 | 12/1972 | Seaberg | 172/804 |
| 3,774,696 | 11/1973 | Horsch | 172/804 |
| 4,067,394 | 1/1978 | Deckler | 172/130 |

*Primary Examiner*—Richard J. Johnson
*Attorney, Agent, or Firm*—William R. Nolte

[57] ABSTRACT

A device for varying the angular setting of the blade of an earthmoving vehicle by means of a pair of double acting hydraulic cylinders in which only one of the cylinders receives pressure direct from a pump. The piston of that cylinder acts on one end of the blade and at the same time transmits pressure fluid through a hydraulic circuit to the piston of the other cylinder acting on the other end of the blade whereby the two pistons move in opposite directions. The hydraulic circuit includes a control valve for reversing the direction of movement of the pistons, the same cylinder being pressurized by the pump in both directions of movement of the pistons. Pressure fluid leakage loss compensating means are provided in each piston.

2 Claims, 4 Drawing Figures

DEVICE FOR SETTING BLADE OF EARTHMOVER

BACKGROUND OF THE INVENTION

This invention relates to a device for the variation of the setting of an angling blade of earthmoving machinery on swivelling or tilting with the aid of hydraulically operated piston/cylinder units arranged to pairs. In normal practice the movement of angling blades is effected by a pair of piston/cylinder units arranged one on the left and one on the right, whereby the cylinders are pressurized simultaneously and in opposed sense. A drawback of such a system is that the piston/cylinder units operate at different speeds depending on the back pressure against the blade on the relevant side. This drawback can only be eliminated by means of so-called flow dividers and additional hydraulic components. A further difficulty to be contended with is in the occurrence of oil losses through leakages in pistons and cylinders which are not compensated and cause the tilting thrust to drop so that in limiting cases no cylinder movement and hence no tilting movement is possible.

The invention has therefore the object of eliminating these shortcomings and of providing a device which allows at any time proper swivelling and tilting in the simplest fashion and with simple means.

SUMMARY OF THE INVENTION

According to the invention, there is provided a device for varying the angular setting of a blade of an earthmoving machine by means of a pair of double acting hydraulic piston and cylinder units, spaced apart and operative on one side of the blade, wherein only one of the units is connected to a pressure fluid source to receive pressure fluid directly therefrom, and wherein pressure chambers of both units are so interconnected through a control valve that when pressure acts upon a face of one piston to move the piston in one direction, pressure fluid displaced by the other face of that piston is employed to move the piston of the other unit in the opposite direction.

The invention is distinguished by the feature that only one cylinder is pressurized directly by the pump and that in the other cylinder the pressure fluid displaced from the pressurized cylinder acts with its secondary pressure in the opposite direction.

Preferably, pressure fluid leakage loss compensation means are provided in each piston. Conveniently such means may comprise push open valves actuated by contact with the pressure chamber wall at the end of a piston stroke and storage chambers within the pistons for pressure fluid to ensure that the full stroke of each piston is always available.

BRIEF DESCRIPTION OF THE DRAWINGS

One embodiment of the invention is shown in the accompanying drawings of which

DESCRIPTION OF A PREFERRED EMBODIMENT

Figure 1:
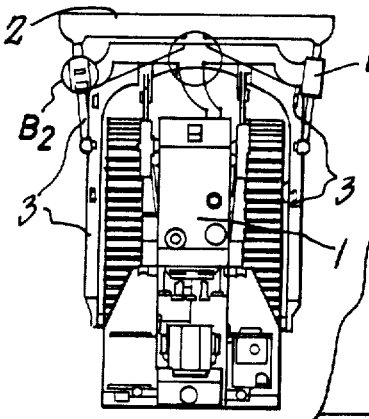
FIG. 1 is a diagrammatic drawing of an earthmoving machine provided with the device.

According to FIG. 1 a track-laying vehicle 1 is provided at the front with an angling blade 2 which is carried in a known manner by a holding frame 3 and which can be swivelled and tilted by means of the right hand or left hand piston/cylinder units $B_1$ or $B_2$. Each piston/cylinder unit comprises a cylinder 4 and in it slides a piston 5 with a piston rod 6. The piston 5 separates inside the cylinder 4 the forward cylinder chamber V, the volume of which is reduced by the piston rod 6, from the rearward chamber H.

In accordance with the invention the chambers V and H of the respective cylinders of the two piston/cylinder units $B_1$ and $B_2$ are connected through a control unit with one another and $B_1$ with a pressure medium source, typically a pump P. The control unit comprises substantially a spool valve 7 displaceable in an axial direction in a housing 8, through which valve pass ducts 20 to 24. In the spool valve housing 8 are correspondingly provided ports 25 to 31 to which the pipes 37 to 43' are connected the other ends of which are connected to the cylinder ports 32 to 36 and the pump P or the sump S, in a manner to be described in more detail below.

Figure 2:
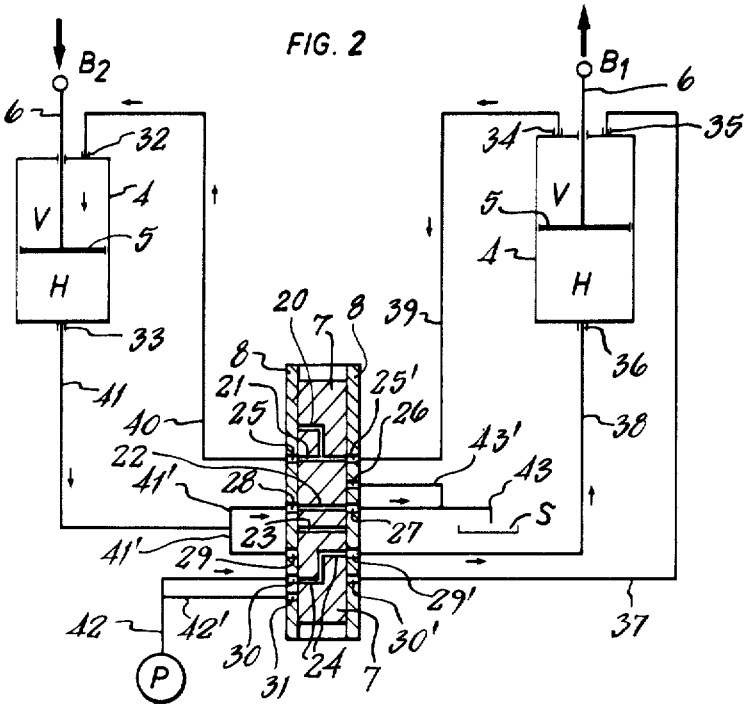
FIG. 2 is a diagrammatic drawing of the hydraulic circuit for the two piston/cylinder units showing components in a first position.

Arrangement and mode of action are as follows:

When the spool valve 7 is at the setting in accordance with FIG. 2 the pump P will be connected through the pipe 42, port 30, duct 24, port 29' and pipe 38 with the port 36 on the cylinder end H of the piston/cylinder unit $B_1$. The piston 5 of this unit will be acted upon by pressure medium and be forced upwards, the hydraulic fluid will be displaced from the cylinder chamber V. The fluid passes through the port 34 and the pipe 39, port 25', duct 21, port 25 and pipe 40 and through the port 32 into the cylinder chamber V of the piston/cylinder unit $B_2$, so that here the piston 5 describes a movement the direction of which is opposed to that described by the piston of the other piston/cylinder unit. The liquid from the cylinder chamber H in piston/cylinder unit $B_2$ returns through the port 33 and the pipes 41, 41', port 28, duct 22, port 27, and pipe 43 back to the sump S.

Figure 3:
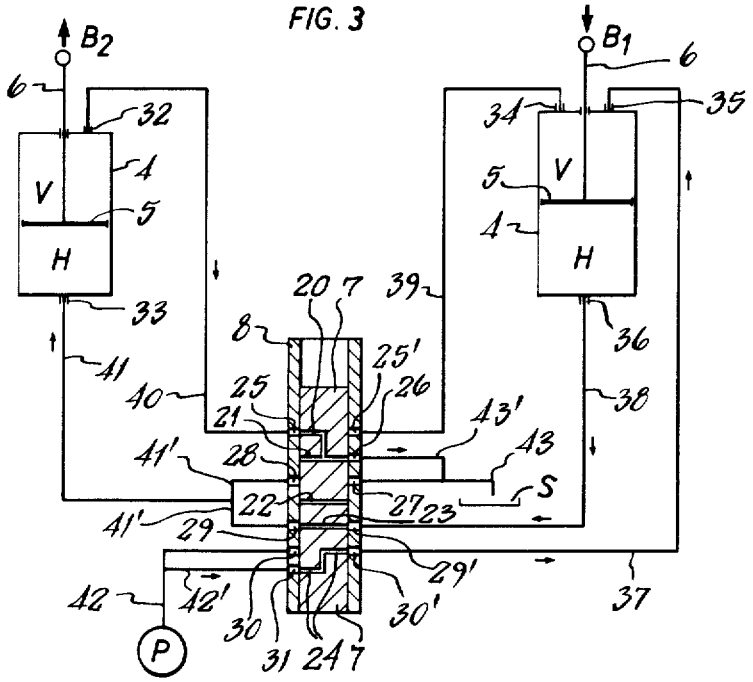
FIG. 3 is a duplicate of FIG. 2 except that some of the components are shown in a second position.

When the blade 2 needs to be moved in the opposite sense the spool valve 7 will be displaced downwards by one switching step into the setting shown in FIG. 3. The pump P will now act through the pipes 42, 42', port 31, duct 24, port 30', pipe 37, and port 35 against the upper face of the piston 5 of the piston/cylinder unit $B_1$. The pipe 39 from port 34 to the port 25' is now blocked by the spool valve 7. The lower cylinder chamber H of the piston/cylinder unit $B_1$ will on the other hand be connected through the port 36, pipe 38, port 29', duct 23, port 29 and pipe 41 with the port 33 of the cylinder chamber H of the piston/cylinder unit $B_2$, so that this face of the piston is acted upon by pressure medium which has been displaced from the cylinder chamber H of the piston/cylinder unit $B_1$. The liquid is free to return from the cylinder chamber V through the port 32, the pipe 40, port 25, duct 20, port 26 and pipe 43' to the sump S.

Figure 4:
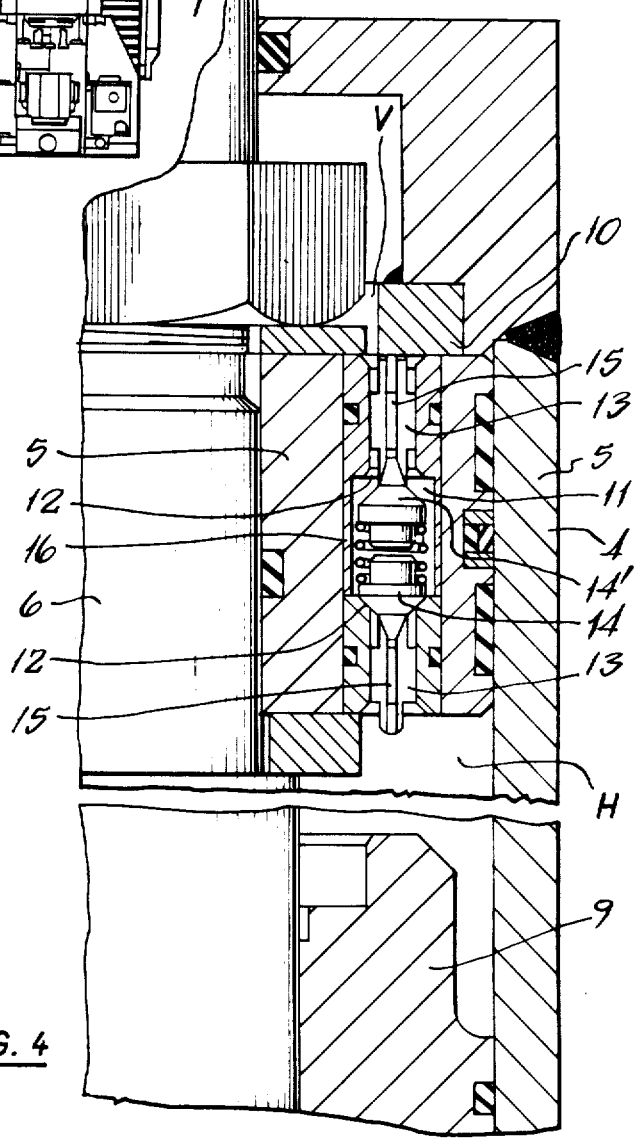
FIG. 4 is a sectioned drawing of a piston a cylinder showing the push-open valves.

As FIG. 4 shows, push open valves 14, 14' are provided in each one of the pistons 5. The piston reciprocates between the cylinder bottom 9 and the cylinder roof 10, which both act as stops for the push open valves 14, 14'. These are fitted in a chamber 11 extending inside the piston 5 and in the chamber 11 are provided valve seatings 12 which leave a passage 13 open towards both piston faces. In the seatings 12 are guided two mutually facing conical poppet valves 14, 14' the stems of which project beyond the piston faces when they rest on their relevant seatings. A spring 16 exerts a continuous force pressing the valves 14, 14' onto their seatings 12, the valves being successively lifted from their seatings by contact of their stems with the bottom 9 or the roof 10 of the cylinders. FIG. 4 shows the position of the valves 14, 14' at the end of the piston stroke when one valve 14' is opened mechanically and the other one 14 by fluid pressure. Normally, spring means 16 force both valves against their seats 12, with the valve stems 15 projecting beyond the surfaces of the piston 5. When the chamber H is pressurized (see FIG. 2), the piston moves upwards. Almost at the end of its stroke the projecting valve stem 15 abuts against the cylinder (as at 10). Since the piston will move on for the rest of the distance, i.e. until it contacts the cylinder 10, the valve 14 is lifted off its seat, opening a passage 13 from the chamer 11 to the chamber V. For a short period, with the piston in its engaging position, pressure rises in the chamber 11 and lifts the valve 14 against the force of the spring 16 off its seat 12 so that pressure fluid flows from the chamber H through passage 13, chamber 11, past valve 14' and through the second passage 13 into the chamber V, if the latter which communicates with the system 39, 25', 21, 25, 40, V of unit B2 can receive an additional volume of fluid. This will be the case after loss of fluid due to leakage in the system. When for opposite movement of the piston in the cylinder, the B1-chamber V is pressurized, actuation of the valves and fluid flow is vice versa with such opposite movement of the piston. The valve H is lifted from its seating by contact with the bottom 9 to release fluid stored in chamber 11 to compensate fluid losses in chamber H. Conveniently the pressure fluid compensation assembly is in a tubular insert sealingly engaged in a bore in the pistons 6 as shown in FIG. 4.

We claim:

1. A device to vary the position of a tiltable blade of earth moving machines including first and second double acting hydraulically operated piston-cylinder units connected to opposite sides of the blade, the piston of each opposed unit dividing its respective cylinder into forward and rear chambers, hydraulic circuit means including control means connected with a source of pressure medium and conduits interconnecting the forward chambers of said opposed units, and additional conduits interconnecting said rear chambers of said opposed units, said control means being connected to said conduits and said additional conduits to control the flow of said pressure medium between said forward chambers of said piston-cylinder units and between their rear chambers, said control means being actuatable to one position, to enable flow of said pressure medium to said rear chamber of said first piston-cylinder unit to cause its piston, to move so that pressure medium from its forward chamber is conveyed to the corresponding forward chamber of said second piston-cylinder unit to simultaneously actuate its piston in a reverse direction, and upon movement of said control means to an alternate position, flow of said pressure medium is directed to the forward chamber of said first piston-cylinder unit to cause the piston of such first unit to move so that pressure medium from the rear chamber of said first chamber is directed to the rear chamber of the second piston-cylinder to thereby simultaneously move its piston a corresponding mount in a reverse direction.

2. Device according to claim 1 wherein pressure fluid leakage loss compensating means are housed within each of said piston-cylinder units, said compensating means comprising a tubular insert sealingly engaged in a bore in the piston of each unit, said insert defining a bore extending between first and second faces of one of said pistons, an enlarged portion of the bore being spaced from said piston faces and forming a fluid storage chamber, and said push-open valves comprise two axially opposed valves in said storage chamber, valve seatings in said storage chamber for respective engagement with the valves to close the bore, each valve having a stem producing respectively from said first and second faces when the valves engage the seatings, means urging the valves into engagement with the seatings, said valve stems respectively extending above one of the faces of said one of said pistons toward the pressure chamber walls at opposite ends of the cylinder, whereby one of said valves will be operated by contact with one of said walls at the ends of each stroke of said one of said pistons to establish passage of fluid from one face of said one of said pistons to the other.

* * * * *